United States Patent [19]

Drummond

[11] 4,311,175

[45] Jan. 19, 1982

[54] LOG CUTTER

[76] Inventor: Byron B. Drummond, 837 S. Germantown Rd., Chattanooga, Tenn. 37412

[21] Appl. No.: 152,837

[22] Filed: May 23, 1980

[51] Int. Cl.[3] ..... B27L 11/02

[52] U.S. Cl. ..... 144/241; 144/176; 144/219

[58] Field of Search ..... 144/176, 181, 162 R, 144/218, 219, 235, 241

[56] References Cited

U.S. PATENT DOCUMENTS

| | | | |
|---|---|---|---|
| 2,805,695 | 9/1957 | Hoheisel | 144/219 |
| 2,964,079 | 12/1960 | Johnson | 144/219 |
| 2,966,182 | 12/1960 | Andrus et al. | 144/181 X |
| 3,327,746 | 6/1967 | Andrus et al. | 144/162 R X |
| 3,675,693 | 7/1972 | I'Anson | 144/241 |
| 3,860,051 | 1/1975 | Anson | 144/241 X |

*Primary Examiner*—W. D. Bray

*Attorney, Agent, or Firm*—Luedeka & Fitch

[57] ABSTRACT

Apparatus for reducing a log to chips comprising a rotatable cutter head adapted for translational movement relative to a log, and carrying a cutting element, such element comprising a length of open-ended tubular or segment there of material having a leading beveled cutting edge which attacks the log to cut away a chip which travels away from the log through the tubular cutting element. The cutting element is matingly and removably received in an appropriate recess in the cutter head thereby providing for mounting of the cutting element on the cutter head with a preselected segment of the leading edge of the cutting element exposed to attack the log.

4 Claims, 6 Drawing Figures

LOG CUTTER

This invention relates to apparatus for reducing logs to chips and particularly to cutting devices for such purposes.

Chips for feeding paper mill digesters are commonly obtained by feeding a log into a rotating cutter. One or a plurality of logs may be fed to the cutter at a given time. The cutter also commonly comprises a cutting head, such as a disc for example, that is mounted for rotation on a shaft that is in turn driven by a motor. The face of the disc most usually carries a large number of replaceable cutting elements. The logs, or slabs may be fed endwise to the cutting head whereupon the entire log or slabs is reduced to chips, or the cutting elements may only attack one side of the log during a pass therealong as in the forming of cants. The present apparatus is suitable for use in either of these situations.

Wear and tear on the cutting elements referred to above is of major concern. Obviously dull cutters require more energy than sharp cutters. Also importantly, the labor and downtime involved in replacing dull or broken cutters represents a substantial cost. Still further, in the prior art it was required that a substantial inventory of costly holders, counter knives, and cutters be maintained to assure against costly downtime while acquiring new cutters or sharpening used cutters.

U.S. Pat. No. 3,612,119 describes one type of apparatus in which the present cutting apparatus can be employed.

The present apparatus provides a combination of a rotatable cutting head and cutting elements (also referred to as cutters) in which the cutters each comprise a length of open-ended tubular material having a leading beveled, i.e. sharpened, edge which attacks the log as the cutting head is rotated. Each cutter is mounted on the cutting head in a holder which is secured to the face of the cutting head to expose a preselected segment of the circular leading edge of the cutter as a cutting segment. Thus each cutter has a continuous circular cutting edge, of which a preselected segment only is used at a given time for cutting. As this segment becomes dull, the cutter is rotated to expose a further, and sharp, segment for cutting purposes. After all segments are dull, a rapid and single sharpening operation returns the entire circular cutting edge to a sharp condition. Severed chips move away from the log through the open-ended cutter.

It is therefore an object of this invention to provide an improved apparatus for reducing a log or portion of a log to chips. It is another object to provide an improved cutter for wood cutting operations. Other objects and advantages of the invention will be apparent from the following description, including the claims and the figures in which:

Figure 1:
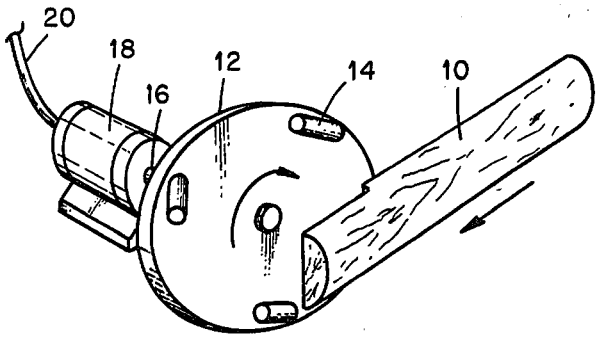
FIG. 1 is a representation of a system for chipping logs in which the cutter attacks a side of the log and embodying various features of the invention.
Figure 2:
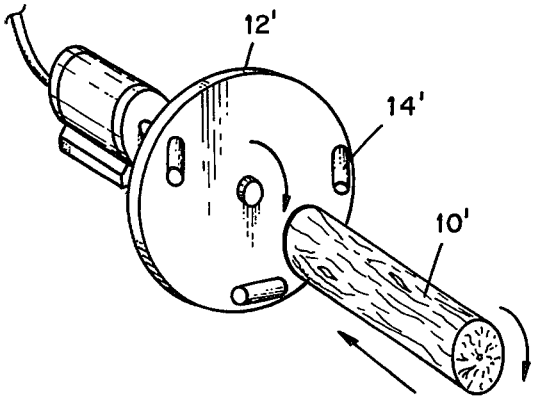
FIG. 2 is a representation of a system as in FIG. 1 except the log or slab is fed endwise to the chipping mechanism.

Referring to FIG. 1, in one embodiment employing the present apparatus, a log 10 is fed forwardly toward a cutting head 12 having a plurality of cutters 14 mounted to the face thereof. The cutting head 12 comprises a disc which is rotatably mounted on a shaft 16 which is in turn driven by a motor 18 connected by an electrical lead 20 to a source of electrical power (not shown). In the embodiment depicted in FIG. 1, the log 10 is caused to present one of its sides to the cutters 14. Referring to FIG. 2, there is depicted the same cutting apparatus as is shown in FIG. 1, but with the log 10' being fed endwise toward the cutters 14'. In the latter instance, the log is rotated to cause all portions of the log end to be presented to the cutters.

Figure 3:
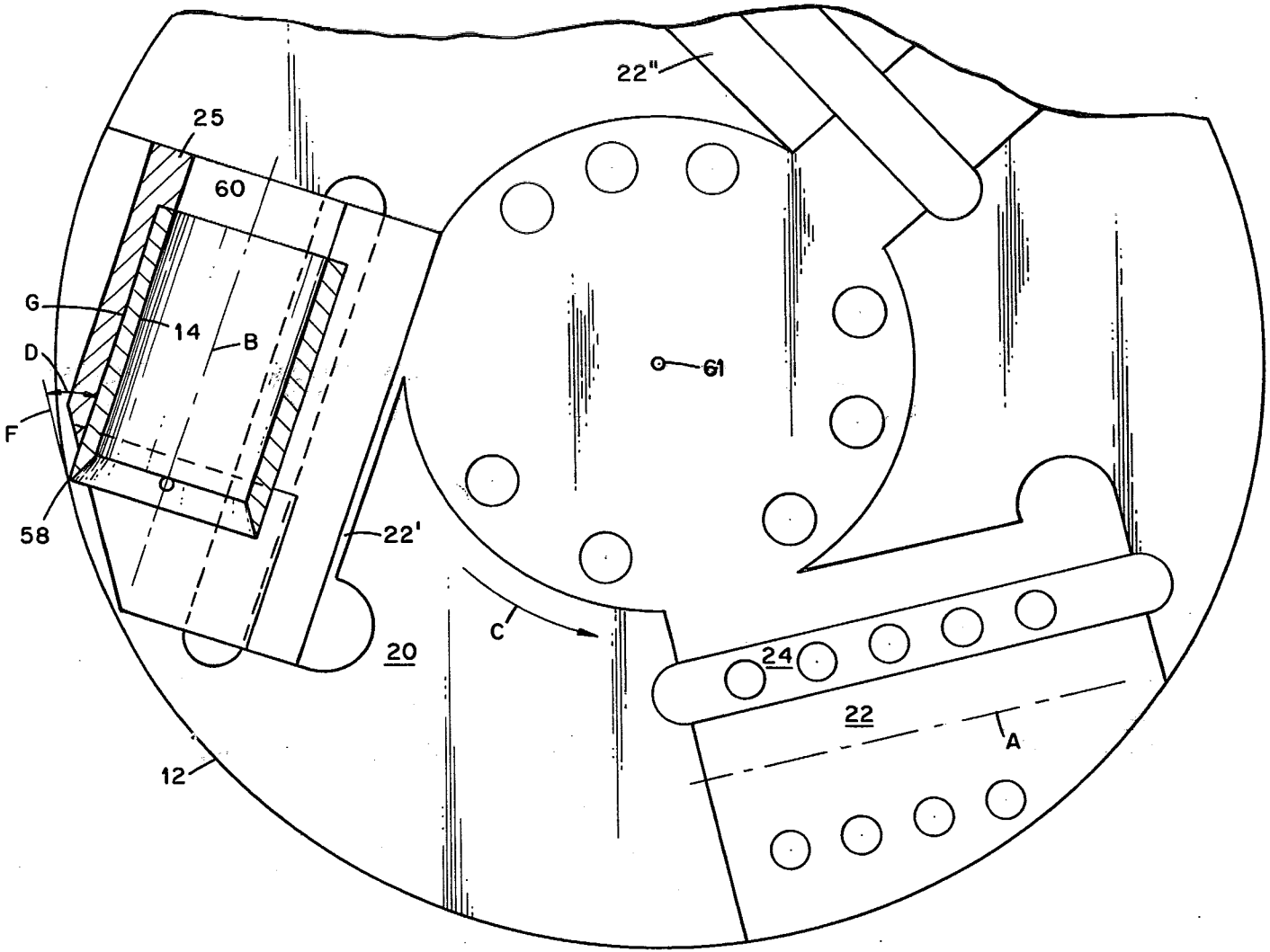
FIG. 3 is a plan view of a portion of the flat front face of a disc-shaped cutting head for receiving the cutting elements disclosed herein, one such cutting element being shown in position.

With reference to FIG. 3, there is depicted a cutting head 12 comprising a disc having a diameter of about 24 inches. On the front face 20 of the disc, there are milled a plurality of recesses 22, 22' and 22" at locations spaced apart from one another by 120°. Each recess is further provided with an elongated milled keyway 24 which is oriented parallel to the longitudinal axis A of the recess 22. The several recesses 22, 22' and 22" are identical.

With reference to FIGS. 3, 4, 5 and 6, each of the recesses 22 is adapted to receive therein a cutter holder 25. The base portion 26 of the cutter holder is provided with a side edge 27 which resides in contact with the side wall 28 of the recess 22. The base 26 further has milled therein a keyway 28 which is in alignment with the keyway 24 provided in the recess 22. A key 30 is received in the mating keyways 24 and 28 to precisely align the cutter holder 25 within the recess 22. The holder 25 is secured to the disc 12 as by a plurality of bolts 32.

Figure 4:
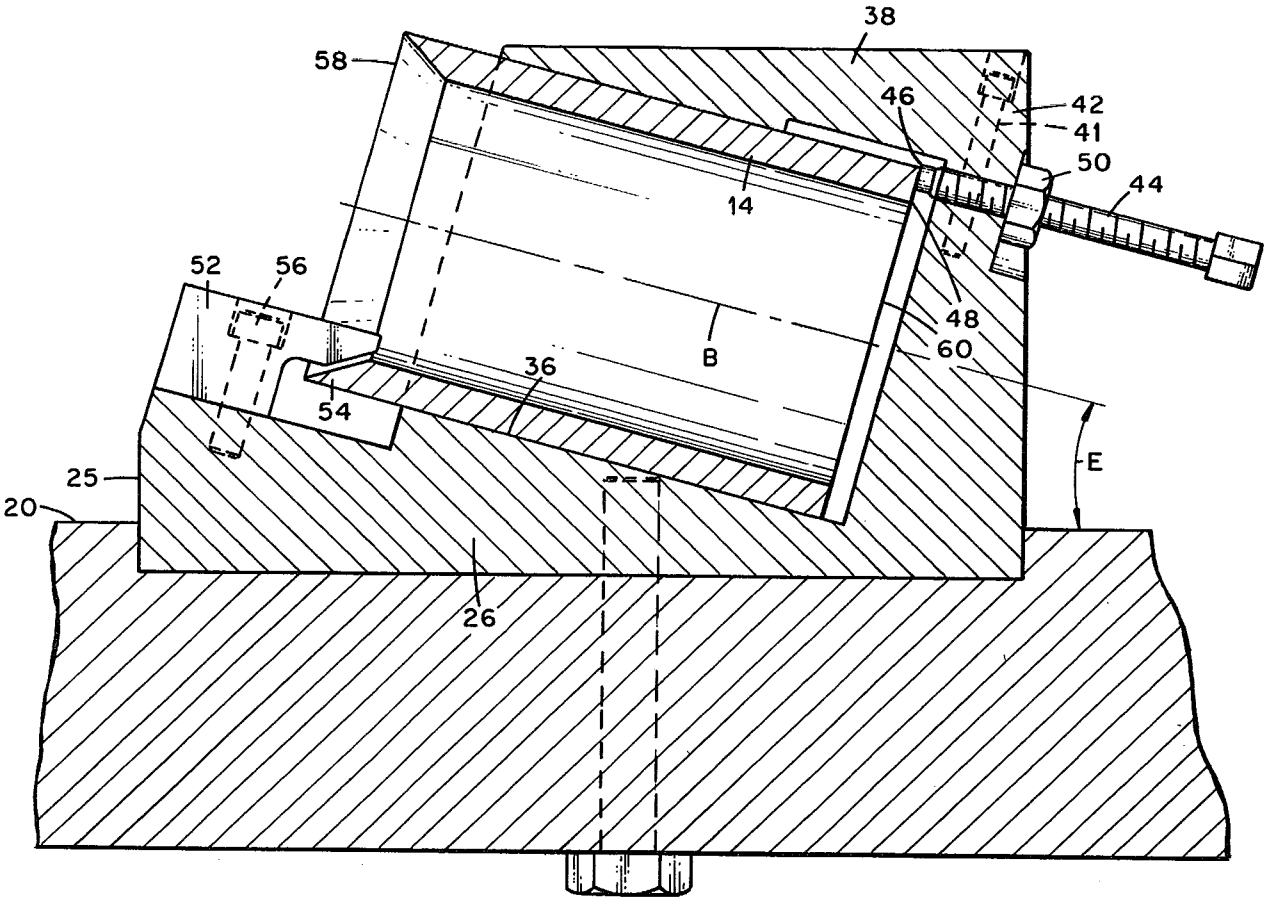
FIG. 4 is a fragmentary, partly cut-away side view of a cutting element mounted on the cutting head shown in FIG. 1.
Figure 5:
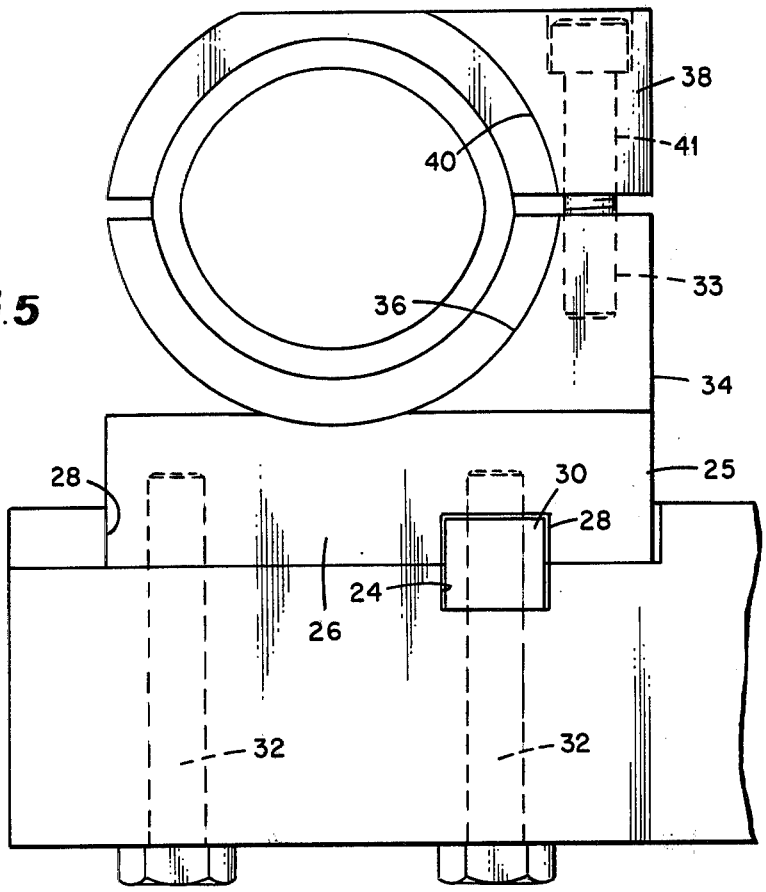
FIG. 5 is a view taken generally along the line 5—5 of FIG. 4.

The cutter holder 25 is further provided with an upstanding section 33 which extends along the most radially inward side 34 of the cutter holder 25. The inner surface 36 of this upstanding portion 33 is ground to a smooth arcuate surface having the same radius of curvature as the outer circumference of the cutter 14 to provide an elongated arcuate cradle within which the cutter may reside. The cutter holder further includes a clamp member 38 which extends along the side 34 of the cutter holder and is similarly provided with an arcuately shaped inner surface 40 to engage the outer circumference of the cutter 14. This upper section 38 of the cutter holder is secured to the upstanding portion 32 thereof as by a plurality of bolts 41. Referring to FIG. 4, it will be observed that the side section 38 of the cutter holder is provided at its rear end 42 with an adjustment bolt 44 whose innermost end 46 bears against the rear end 48 of the cutter 14 to adjust the longitudinal position of the cutter 14 within the cradle which is defined by the cutter holder 25. A lock nut 50 is provided on the screw 44 to anchor it against inadvertent movement.

Figure 6:
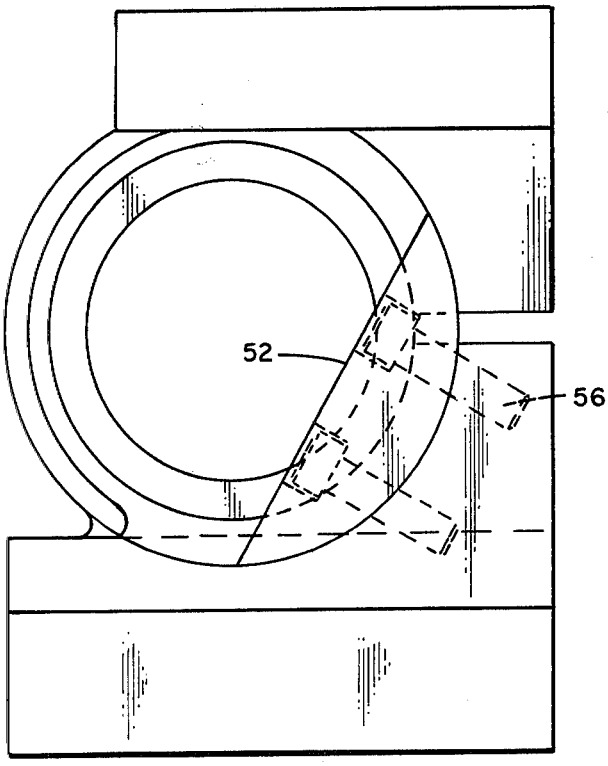
FIG. 6 is a view looking at the leading edge of the cutting element as shown in FIG. 4.

When the cutter 14 is in position within its cradle within the cutter holder 25, there is positioned a retainer 52, adjacent the leading edge 54 of the cutter 14. This retainer 52 is secured to the cutter holder 25 as by bolts 56. It will be noted that in FIG. 4, the retainer 52 is shown 45° off its normal position for illustration purposes. In FIG. 6, the retainer is shown in the proper orientation with respect to the cutter holder 25.

It will be noted from FIG. 4, that the arcuate surface 36 of the cutter holder 25 is oriented at an angle of about 15° with respect to the planar front face 20 of the disc 12. In this manner, the longitudinal centerline A of the recess 22 and the longitudinal centerline B of the cutter 14 are oriented at an angle E of about 15° with respect to the face of the disc 12. This alignment of the cutter with respect to the disc face provides a leading, i.e., cutting edge 58 that projects outwardly from the face of the disc such that as the disc is rotated, the edge 58 is exposed to attack a log which is urged toward the disc face. Further, as viewed in the plan view of FIG. 3, the longtitudinal side margin G intersects a line F that is tangent to the outef circumference of the disc 12 at an angle D of about 37 degrees. By reason of the orientation of the cutter leading edge with respect to the face of the disc 12 due to the angles D and E and the fact that the disc is rotated about its center 61 in the direction indicated by the arrow C (FIG. 3), the cutting edge 58 of the cutter is caused to attack a log with a slicing type motion thereby enhancing the generation of a chip of a desired shape and size. The present design of the cutter 14 (that is, its open-ended tubular construction) and the design of the clamp for mounting the cutter to the disc 12, are such that chips cut from a log pass through the open interior of the cutter 14 and exit from the open rear end 60 thereof.

In one embodiment, the leading edge 54 of the cutter 14 is beveled interiorly of the cutter 14 at an angle of about 30° with respect to the length dimension of the cutter to provide the cutting edge 58. By this design, sharpening of the cutter 14 comprises a relatively simple operation of regrinding the bevel to develop a fresh cutting edge 58. By reason of the adjustment screw 44 provided at the rear of the cutter 14, the cutter 14 can be positioned forwardly to accommodate a reduction in its length by reason of it having been sharpened one or more times. In this manner, a single tubular cutter can be sharpened numerous times thereby effecting a savings in the cost of the cutters.

In one specific embodiment of the present apparatus, the disc 24 is 24 inches in diameter. As depicted in the several figures, preferably there are three cutters removably secured to the front face 20 of the disc 12 at locations disposed 120° apart around the circumference of the disc. One particular suitable cutter is of a steel material hardened to a Rockwell C hardness of 40. Such cutter preferably is $4\frac{3}{8}$ inch outside diameter with a $\frac{3}{8}$ inch thick wall and a length of 6 inches.

In an operation involving the described apparatus, the disc typically is driven at approximately 600 revolutions per minute and a log is fed to the disc at a rate of about 112.5 feer per minute employing the configuration depicted in FIG. 1. Under these conditions, each cutter takes a $\frac{3}{4}$ inch deep bite into the log and carves away a chip about $2\frac{3}{4}$ inches long per each revolution of the disc. The chips cut away from the log passes through the hollow interior of the cutter to fall away from the cutting area.

Whereas a specific embodiment has been described herein, it is intended to limit the invention only in accordance with the claims attached hereto.

I claim:

1. Apparatus for reducing a log to chips comprising a rotatable circular disc cutter head adapted for translational movement relative to a log, said cutter head carrying a cutting element, said element comprising a length of open-ended tubular material having a leading beveled cutting edge which attacks the log to cut away a chip which travels away from the log through said tubular cutting element, means releasably mounting said cutting element on said cutting head with the longitudinal side margin of said cutting element oriented at about 37 degrees with respect to a tangent to the outer circumference of said disc at the intersection of said side margin with said circumference and at an angle of about 15 degrees with respect to a planar face of said disc, said last means comprising a base member defining a cradle and means securing said cutting element in said cradle.

2. The apparatus of claim 1 including means associated with said mounting means for said cutting element for adjusting the position of said cutting element within said mounting means along a dimension parallel to the longitudinal dimension of said cutting element.

3. The apparatus of claim 1, wherein the leading edge of said cutting element is beveled interiorly of said cutting element at an angle of about 30 degrees with respect to the length dimension of said cutting element to provide the cutting edge.

4. The apparatus of claim 2, wherein said adjustment means comprises an elongated threaded device threadably mounted to said mounting means with its longitudinal axis generally parallel to the longitudinal axis of said cutting element and having one end bearing against the rear end of said cutting element, such that said adjustment device is moved longitudinally toward said cutting element as it is turned in one direction in its threaded mounting with said mounting means and pushes said cutting element longitudinally to adjust the longitudinal position of said cutting element within said cradle.

* * * * *